US012163384B2

(12) United States Patent
Fanini et al.

(10) Patent No.: US 12,163,384 B2
(45) Date of Patent: Dec. 10, 2024

(54) ADAPTIVE CONTROL OF ROTATING OR NON-ROTATING TRANSDUCER AND SENSORS CASING STAND-OFF SUPPORTED BY CASING CENTRALIZERS

(71) Applicant: Halliburton Energy Services, Inc., Houston, TX (US)

(72) Inventors: Otto Fanini, Houston, TX (US); Gary Wayne Kainer, Houston, TX (US); Batakrishna Mandal, Houston, TX (US); Gennady Koscheev, Houston, TX (US); Marvin Batres, Houston, TX (US); Lesley Allison Fessler, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/579,972

(22) Filed: Jan. 20, 2022

(65) Prior Publication Data

US 2023/0243220 A1 Aug. 3, 2023

(51) Int. Cl.

| | |
|---|---|
| ***E21B 17/10*** | (2006.01) |
| ***E21B 47/01*** | (2012.01) |
| ***E21B 47/09*** | (2012.01) |

(52) U.S. Cl.

CPC ..... *E21B 17/1021* (2013.01); *E21B 17/1057* (2013.01); *E21B 47/01* (2013.01); *E21B 47/09* (2013.01)

(58) Field of Classification Search

CPC .. E21B 17/1057; E21B 47/01; E21B 17/1021; E21B 47/09

See application file for complete search history.

(56) References Cited

U.S. PATENT DOCUMENTS

| | | | |
|---|---|---|---|
| 5,763,773 | A | 6/1998 | Birchak et al. |
| 7,471,591 | B2 | 12/2008 | Tello et al. |
| 9,664,034 | B2 | 5/2017 | Mandal |
| 9,963,964 | B2 | 5/2018 | Jones |
| 10,100,628 | B2 | 10/2018 | Mouget et al. |
| 10,138,727 | B2 | 11/2018 | Zeroug et al. |
| 10,988,991 | B1 | 4/2021 | McCormick |

(Continued)

OTHER PUBLICATIONS

Ellison, Candice & Overa, Sean & Boldor, Dorin. (2018). Central Composite Design Parameterization of Microalgae/Cyanobacteria Co-culture Pretreatment for Enhanced Lipid Extraction Using an External Clamp-On Ultrasonic Transducer. Ultrasonics Sonochemistry. 51. 10.1016/j.ultsonch.2018.05.006. (Year: 2018).*

(Continued)

*Primary Examiner* — Theodore N Yao

(74) *Attorney, Agent, or Firm* — Conley Rose, P.C.; Rodney B. Carroll

(57) ABSTRACT

A downhole sensor position adjustment device on a downhole sensor assembly comprising a set of centralizers and a sensor array coupled to an adjustable framework radially positionable by an actuator. The actuator includes an extend-retract mechanism to radially position the sensor array a predetermined radial distance to an inner surface of a casing. A controller communicatively coupled to the extend-retract mechanism is configured to actuate the extend-retract mechanism. A positioning sensor provides feedback of the predetermined radial distance of the sensor array to the inner surface of the casing.

21 Claims, 6 Drawing Sheets

(56) References Cited

U.S. PATENT DOCUMENTS

| | | | | |
|---|---|---|---|---|
| 11,442,193 | B2 * | 9/2022 | Beard | E21B 47/00 |
| 2004/0216873 | A1 | 11/2004 | Frost, Jr. et al. | |
| 2011/0031023 | A1 | 2/2011 | Menezes et al. | |
| 2011/0138903 | A1 * | 6/2011 | Large | E21B 47/0025 73/152.17 |
| 2014/0301164 | A1 * | 10/2014 | Mandal | G01V 1/52 367/35 |
| 2016/0032717 | A1 | 2/2016 | Parker | |
| 2018/0003850 | A1 * | 1/2018 | Jaaskelainen | E21B 17/1021 |
| 2019/0063214 | A1 * | 2/2019 | Castillo | E21B 17/1057 |

OTHER PUBLICATIONS

Candice Ellison,et al (2018) Dielectric characterization of bentonite clay at various moisture contents and with mixtures of biomass in the microwave spectrum, Journal of Microwave Power and Electromagnetic Energy, 52:1, 3-15, DOI: 10.1080/08327823.2017.1421407 (Year: 2018).*

"Well Integrity Technology," Plug and Abandonment Catalog, 2020, 12 pages, Shlumberger.

"Cement Bond Logging Tools," 2007, 4 pages, Shlumberger.

"Isolation Scanner: Advanced Evaluation of Wellbore Integrity," 2011, 8 pages, Schlumberger.

"PowerFlex | PowerEcho: Annular Barrier Evaluation Services," 2017, 12 pages, Schlumberger.

Zeroug, Smaine et al., "Sonic and Ultrasonic Measurement Applications for Cased Oil Wells," 19th World Conference on Non-Destructive Testing, 2016, pp. 1-12, Schlumberger.

Foreign Communication from Related Application—International Search Report and Written Opinion of the International Searching Authority, International Application No. PCT/US2022/013589, dated Oct. 14, 2022, 9 pages.

* cited by examiner

ADAPTIVE CONTROL OF ROTATING OR NON-ROTATING TRANSDUCER AND SENSORS CASING STAND-OFF SUPPORTED BY CASING CENTRALIZERS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Understanding the structure and properties of geological formations can reduce the cost of drilling wells for oil and gas exploration. Measurements made in a borehole (i.e., down hole measurements) are typically performed to attain this understanding, to identify the composition and distribution of material that surrounds the measurement device down hole. To obtain such measurements, logging tools of the acoustic type are often used to provide information that is directly related to geo-mechanical properties.

Some acoustic tools utilize transmitters to create pressure waves inside the borehole fluid, which in turn create several types of waveguide modes in the borehole. Corresponding modes of propagation occur in the formation surrounding the borehole, and each of these can be used to provide information about formation properties. Thus, data associated with the various modes can be acquired and processed to determine formation properties, such as compression and shear wave velocity in the formation. For this reason, acoustic tools are an integral part of modern geophysical surveys, providing information on the mechanical properties of the medium by measuring acoustic modes of propagation.

When using conventional acoustic tools, the sensors to measure the acoustic signals are sensitive to the distance between the sensor and the casing surface. An acoustic tool that is adaptable to different sizes of casing is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Imaging through wellbore casing is a challenging problem, the solution of which is useful to provide cement evaluation, and to prevent leaks. Some CAST (circumferential acoustic scanning tool) systems with pulse-echo devices currently provide some degree of inspection with respect to the integrity of the casing, and the cement adjacent to the casing. However, the cement/formation boundary and the interface behind the casing remain ill-defined in many instances.

This is because, even though perpendicular reflectors behind the casing can be detected using pulse-echo devices, it is difficult to separate the casing reverberation signal from signals of interest due to reflected signal strengths that originate from the interface behind the casing. If the interface is not normal to the incident waveform, then recovering reflected signals is extremely difficult when a pulse-echo device is used. Therefore, a different type of ultrasonic imaging tool is needed to image thorough the casing, to define the interface behind the casing.

To address some of the challenges described above, as well as others, apparatus, systems, and methods for improving the acquisition of acoustic waveform information with a unique variable radial placement of one or more acoustic sensors are described. Various embodiments include an adjustable sensor mount for single transducers an array of pitch-catch transducers. This mechanism helps place the sensors within a predetermined radial distance to the inner surface of the casing with greater accuracy, and can improve imaging ability. Various example embodiments that can provide some or all of these advantages will now be described in detail.

Figure 1:
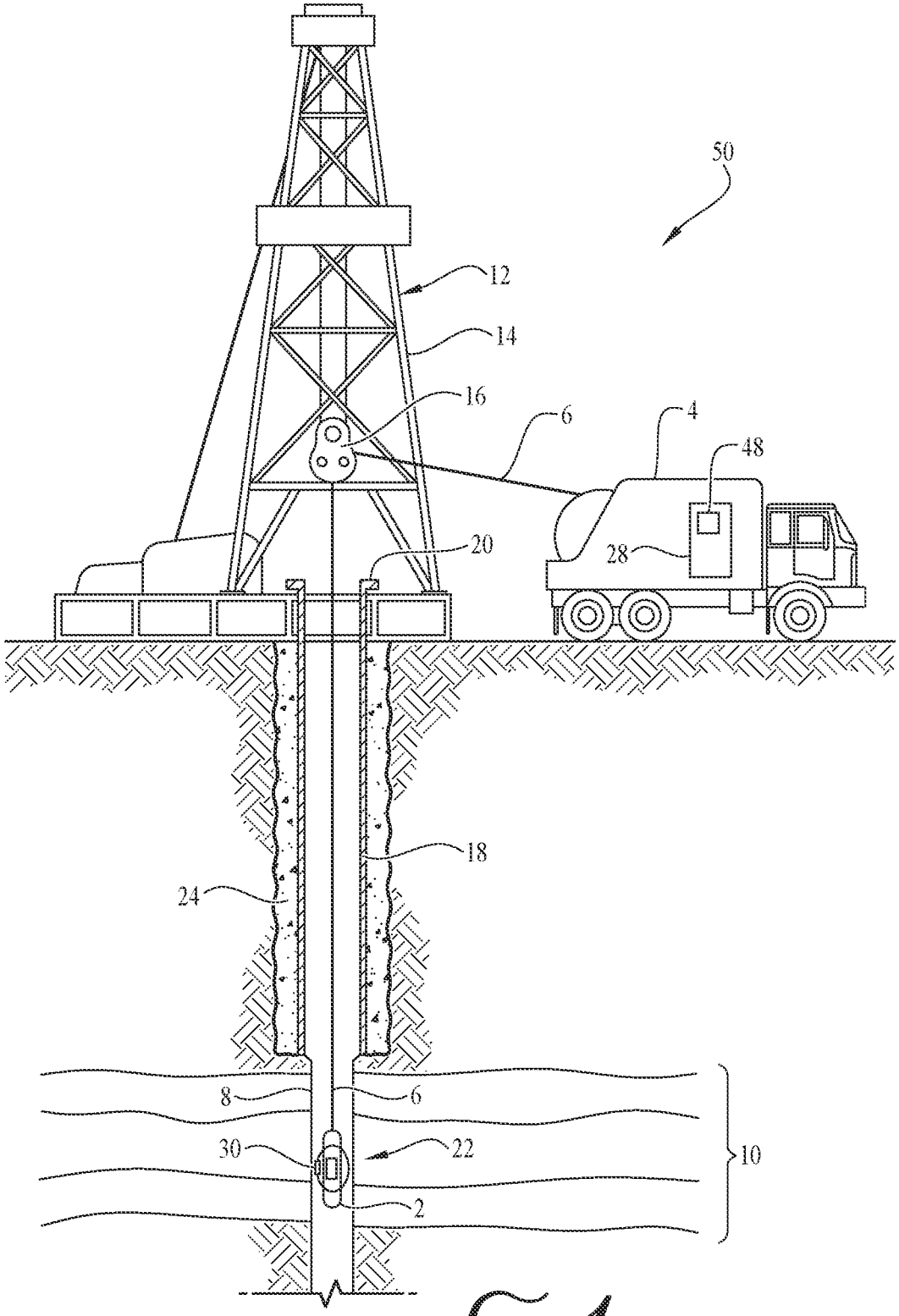
FIG. 1 is an illustration of a wireline operating environment at a wellsite according to an embodiment of the disclosure.

Turning now to FIG. 1, a wellbore servicing environment 50 is described. In an embodiment, a wireline logging operation can comprise a wireline logging tool assembly 22 communicatively coupled to a surface logging equipment by wireline or logging cable 6. Typically, a wireline logging tool body 2 is lowered into a wellbore 8 to survey a region of interest, e.g., formation 10.

The wireline logging operation can be performed with a drilling or workover rig 12 comprising a derrick 14 and various wireline equipment 16 for the conveyance of the wireline logging tool assembly 22 into the wellbore 8. The wellbore 8 may include one or more casing string 18, e.g., pipes threadingly coupled together, and anchored at surface with a wellhead 20. The casing string 18 can be cemented within the wellbore 8. All of the wellbore 8 can include casing string 18 and cement or a portion of the wellbore 8 may not include casing string 18.

The wireline logging operation comprises lowering the wireline logging tool assembly 22 to a target depth, e.g., the formation 10, and subsequently pulling the wireline logging tool assembly 22 upward (toward the surface) at a substantially constant speed. The wireline logging tool assembly 22 comprises a wireline logging tool body 2 and at least one sensor 30. During the upward motion through a target zone, e.g., a series of depths, one or more sensors 30 included within the wireline logging tool body 2 may perform measurements within the wellbore 8. For example, the one or more sensors 30 included within the wireline logging tool body 2 can make one or more measurements of the formation 10, the cement 24, the casing string 18, or combinations thereof. The wireline logging tool body 2 may include one or more processors, memory, and a data acquisition process executing in memory. The measurement data may be stored in memory or transmitted to surface via the logging cable 6. The measurement data can be communicated to a surface logging facility 4 for storage, processing, and analysis. The surface logging facility 4 may be provided with electronic equipment, e.g., computer system, for various types of signal processing. Similar formation evaluation data may be gathered and analyzed during drilling operations (e.g., during LWD (logging while drilling) operations, MWD (measurement while drilling) operations, and by extension, sampling while drilling).

In some embodiments, the wireline logging tool assembly 22 comprises an acoustic instrument (e.g., sensor 30) for obtaining and analyzing acoustic noise measurements from a subterranean formation 10 through a wellbore 8. The logging tool body 2 is suspended in the wellbore 8 by a logging cable 6 that connects the logging tool body 2 to a surface unit controller 28, e.g., computer system. The logging tool body 2 with the sensor 30 may be deployed in the wellbore 8 on a workstring comprising wireline, coiled tubing, jointed drill pipe, hard wired drill pipe, or any other suitable deployment technique.

Figure 2:
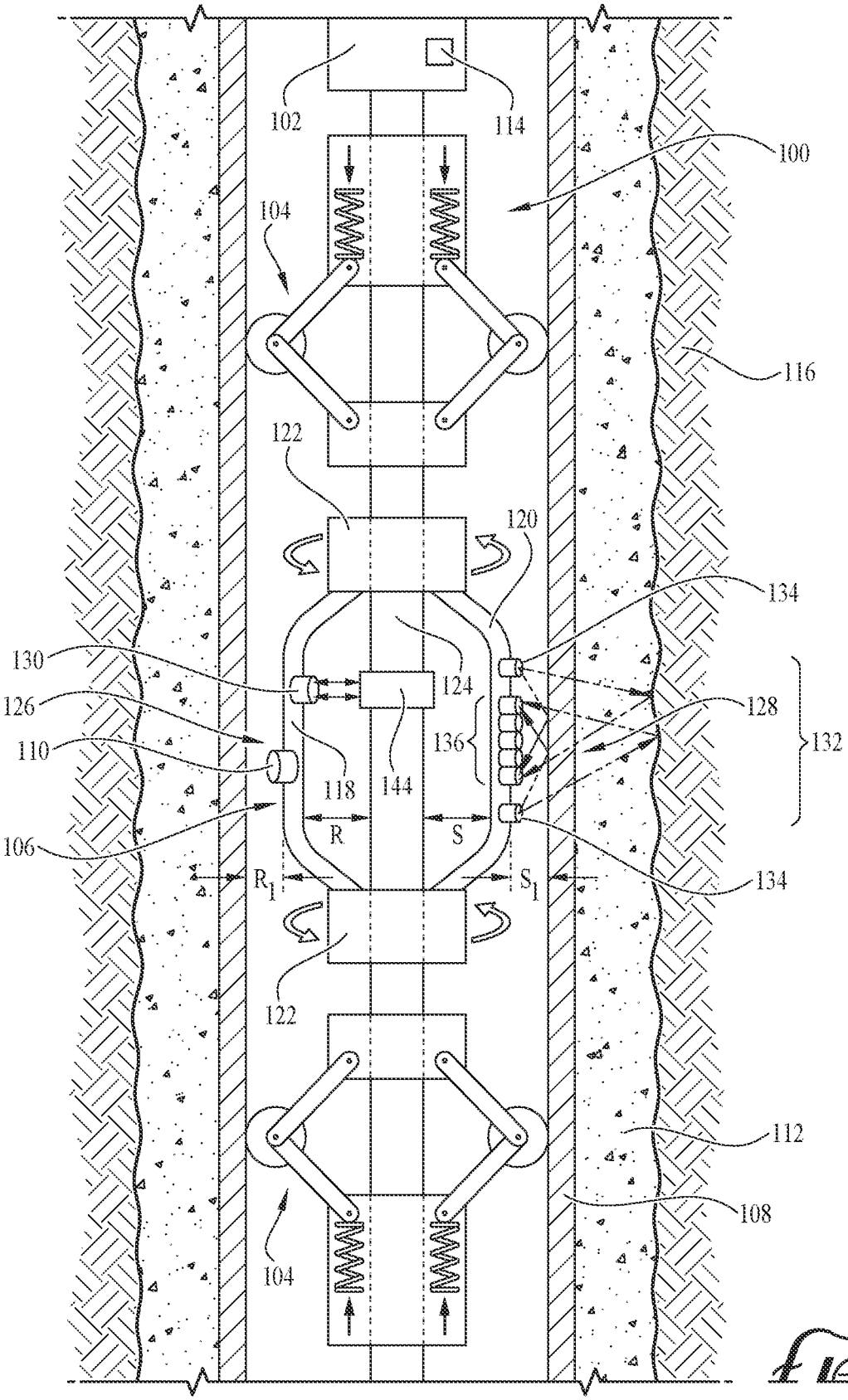
FIG. 2 is a side view of a downhole logging tool assembly with a fixed framework according to an embodiment of the disclosure.

Turning now to FIG. 2, an embodiment of the wireline logging tool assembly 22 is illustrated. For example, FIG. 2 illustrates a side view of a downhole logging assembly 100. In some embodiments, the downhole logging assembly 100 comprises a housing 102, at least one centralizer assembly 104, a rigid framework 106, a first sensor array 126, and a second sensor array 128 The first sensor array 126 and/or second sensor array of the logging assembly 100 may comprise at least one ultrasonic tool, e.g., sensor 30 of FIG. 1, coupled to the rigid framework 106.

The housing 102 can include a controller 114 comprising at least one processor, memory, and a means to communicatively connect to the logging cable 6. The controller 114 may be communicatively connected to the first sensor array 126 and/or the second sensor array 128 mounted on the rigid framework 106 and at least one centralizer assembly 104. One or more processes in memory may include means to collect periodic datasets from the sensor arrays, e.g., sensor array 126, and transmit the datasets to surface via the logging cable 6. The controller 114 may control the rigid framework 106 and a plurality of sensors independently, in response to communication from the surface unit controller 28, or combinations thereof.

The rigid framework 106 can comprise a first arm 118, a second arm 120, and at least one rotating motor mount 122. The rigid framework 106 can be non-adjustable and fixed in radial distance from the body 124. The first sensor array 126 can be mechanically coupled to a first arm 118 spaced a radial distance "R" from the body 124. The second sensor array 128 can be mechanically coupled to a second arm 120 spaced a radial distance "S" from the body 124. The radial distance "R" for the first arm 118 can be the same or different from the radial distance "S" for the second arm 120. The radial distance "R" for the first arm 118 and "S" for the second arm 120 can be fixed and non-adjustable with the rigid framework 106. The rotating motor mount 122 can rotationally couple the first arm 118 and second arm 120 to the body 124. The rotating motor mount 122 can include a gear ring and a slip ring to generate rotational motion of the rigid framework 106 relative to the body 124 while providing signal communication between the controller 114 and sensor arrays 126 and/or 128. The rotating motor mount 122 can rotate the rigid framework 106 relative to the body 124 and the casing 108. Although the rotating motor mount 122 is illustrated located above and below the rigid framework 106, it is understood that the rotating motor mount 122 may be located on only one side, for example on the uphole or housing 102 side, and a rotatable support (without the motor) can be located on the other side.

The first sensor array 126 on the first arm 118 of the rigid framework 106 can include a first pulse-echo device 110 for survey of the casing 108 and a second pulse-echo device 130 for measurement of one or more fluid properties given the distance between the second pulse-echo device 130 and a receiver 144 is known and constant. The first pulse-echo device 110 can include a pulse-echo CAST transducer oriented radially towards the casing 108. The second pulse-echo device 130 can include a second pulse-echo transducer oriented towards receiver 144 coupled to the body 124. The first pulse-echo device 110 and second pulse-echo device 130 can measure datasets as the rotating motor mount 122 rotates the rigid framework 106 relative to the body 124 and thus the casing 108. The first arm 118 can locate the first sensor array 126, e.g., pulse-echo device 110, at a radial distance R2 from the inner surface of the casing 108. Although the sensor array 126 is described at a radial distance R2 from the casing 108, it is understood that the radial distance R2 may be measured from the inner surface of any tubular member including casing 108, primary casing, surface casing, secondary casing, liner, production liner, production tubing, coil tubing, or any similarly cylindrical shaped product. In some embodiments, the sensor array 126 may located at a radial distance R2 from the inner surface of a section of the wellbore 8 without a tubular member such as formation 10 of FIG. 1. A target surface may be defined as an inner surface of a target zone that the sensor array 126 may send and receive acoustic signals to. For example, the target surface may be the inner surface of the casing 108 or the formation 10.

The second sensor array 128 on the second arm 120 of the rigid framework 106 can include a pitch/catch array 132 comprising at least two transmitters 134 and a plurality of receivers 136. Although the receivers 136 are illustrated in a location between the transmitters 134, it is understood that the transmitters 134 can be located between the receivers 136. The receivers 136 can be transducers. In a context, the transmitters 134 and receivers 136 can be transceivers with the ability to transmit and receive signals. The pitch/catch array 132 can provide digital dataset, e.g., images, indicative of features within the cement 112 in the annular space between the casing 108 and the formation 116. The pitch/catch array 132 can minimize unwanted noise (internal reverberation, interfering surface rugosity and irregular surface interface between the cement 112 and the formation 116) and to enhance the second interface survey signal provided by the interface between the cement 112 and the formation 116, when acoustic waveforms are transmitted and received.

In some embodiments, the first sensor array 126 and the second sensor array 128 can be located on an arm, e.g., the first arm 118, of the rigid framework 106. The first sensor array 126 and second sensor array 128 can be arranged to provide a two dimensional (2D) array on the first arm 118 and/or second arm 120.

For the purposes of this document, an "acoustic" waveform means a waveform that provides a record of energy in a band of frequencies that extends from about 20 Hz to about 20 MHz. Acoustic transducers are configured to emit and/or receive waves that have the greater portion of their energy contained within this band of frequencies.

In some embodiments, the downhole logging assembly 100 may include at least one centralizer assembly 104 comprising two or more wheel assemblies comprising a wheel coupled to an arm pair. The arm pair comprises an upper arm and a lower arm pivotably coupled together at the hinge joint. A roller wheel can be rotationally attached, for example, at the hinge joint, by an axle. A first arm, e.g., upper arm, can be attached at a pivot point located on the body 124 and a second arm, e.g., lower arm, can be attached at spring mechanism. The spring force bias the second arm to the hinge joint to radially extend the roller wheel to contact the inner surface of the casing 108 while the pivot point provides a reaction force with the first arm. The centralizer assembly 104 may include two or more wheel assemblies radially spaced about the longitudinal axis of the body 124. For example, the downhole logging assembly 100 may have 3 wheel assemblies radially positioned at approximately 120 degrees about the body 124. In another scenario, the centralizer assembly 104 may include 4 wheel assemblies radially positioned at approximately 90 degrees. It is understood that the centralizer assembly 104 may have 2, 3, 4, 5, 6, 7, 8, or any number of wheel assemblies. In some embodiments, two roller wheels can be attached via a frame at the hinge joint. In some embodiments, the downhole logging tool assembly can include two centralizers assemblies 104 with one on an uphole side and the other on a downhole side of the rigid framework 106. In some embodiments, the downhole logging tool assembly can include three centralizers assemblies 104 with two on an uphole side and one on a downhole side of the rigid framework 106.

In some embodiments, the at least one centralizer assembly 104 can include a steerable swivel joint coupled between the wheel and hinge joint of the arm pair. The steerable swivel joint can actively steer, e.g., angle the wheel, the wheel into a helical path along the target surface, e.g., inner surface of the casing 108. The helical path can be defined as the radial path of the wheels and the longitudinal direction of the downhole logging assembly 100 via the logging cable 6. For example, the steerable swivel joint can act as a pivot allowing the roller wheel to pivot by an angle sufficient to allow the roller wheel to be pointed at and directed to follow with its rolling motion a helical rotational path inside the inner surface of the wellbore 8 and/or tubular. This helical rotational path can be defined by the relationship between the axial longitudinal logging speed of the downhole logging assembly 100 inside the wellbore 8 and the angular rotation speed (rad/sec; RPM) of the first arm 118 and/or second arm 120 around the axis of the wellbore 8. In some embodiments, the roller wheels can take the form of a roller ball allowing the same degree of freedom of motion along the helical rotational path along the target surface (the inner surface of the wellbore 8, casing 108, or tubular).

In some embodiments, the downhole logging assembly 100 may include a flexible framework comprising movable arms. The first sensor array 126 may be coupled to a first movable arm with a first actuator. The second sensor array 128 may be coupled to a second movable arm with a second actuator. The radial position of the arm relative to the inner surface of the casing 108 may be determined by a sensor mechanism. The controller 114 may be communicatively coupled to sensor mechanism and the actuators. A positioning mechanism including actuators may radially extend and retract the flexible framework. A control mechanism including positioning sensors may provide feedback of the radial position of the movable arms of the flexible framework, and thus the sensor arrays. The controller 114 may radially position the sensor array a predetermined distance away from the inner surface of the casing 108 via the positioning mechanism, e.g., actuators, in response to the control mechanism, e.g., positioning sensors.

Figure 3:
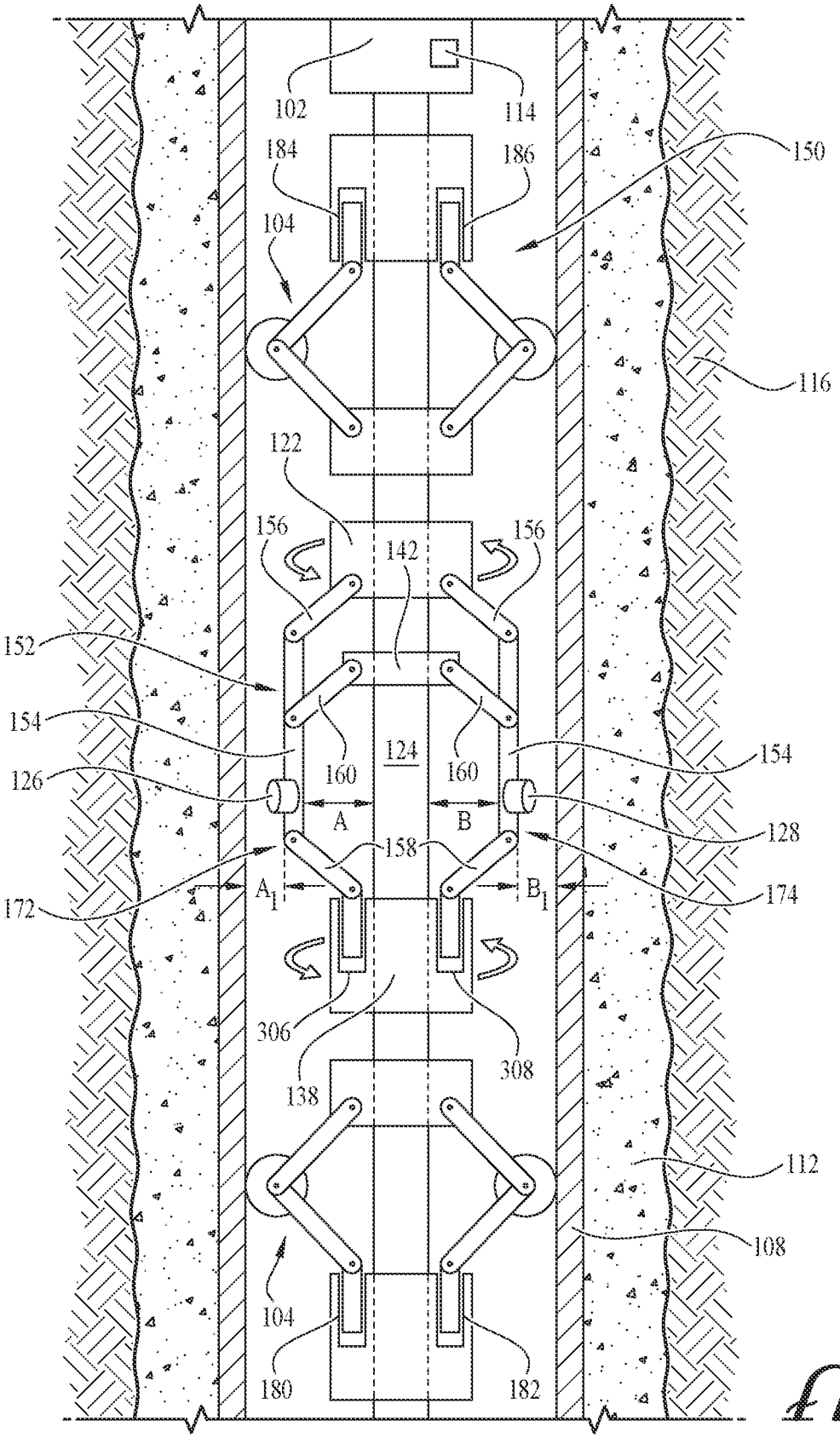
FIG. 3 is a side view of a downhole logging tool assembly with an adjustable framework according to an embodiment of the disclosure.

Turning now to FIG. 3, an embodiment of the wireline logging tool assembly 22 is illustrated. For example, FIG. 3 illustrates a side view of a downhole logging tool assembly 150. In some embodiments, the downhole logging tool assembly 150 comprises a housing 102, at least one centralizer assembly 104, an adjustable framework 152, and a plurality of sensors. The adjustable framework 152 can comprise a first arm 172 with a first sensor array 126 and a second arm 174 with a second sensor array 128. The logging tool assembly 150 may include similar components to FIG. 2 previously described.

The controller 114 within the housing 102 may be communicatively connected to the adjustable framework 152, the first sensor array 126, the second sensor array 128, and at least one centralizer assembly 104. One or more processes executing on a processor within the housing 102 may include means to control the adjustable framework 152, the at least one centralizer assembly 104, collect periodic datasets from the sensors, transmit the datasets to surface, or combinations thereof.

The adjustable framework 152 comprises a first arm 172, a second arm 174, at least one rotating motor mount 122, a rotational support 142, and an actuator support 138. The first arm 172, also referred to as a first range arm assembly, comprises a sensor arm 154, a pivot arm 156, a support arm 160, an actuator arm 158, and an actuator 306, also referred to as a range actuator, rotationally coupled together at a hinge type connection For example, the pivot arm 156 can include a hinge type connection to the sensor arm 154 and the rotating motor mount 122. A positioning mechanism including the actuator 306 can actuate to radially displace the sensor arm 154 via the actuator arm 158. The term actuate can refer to the positioning mechanism extending or retracting to radially displace the sensor arm 154. The actuator 306, e.g., range actuator, can be coupled to an actuator support 138 that is rotationally coupled to the body 124. The actuator 306 of the positioning mechanism can extend, e.g., actuate, to displace the sensor arm 154 radially outward towards the inner surface of the casing 108. The actuator 306 can extend the sensor arm 154 to a radial position A from the sensor arm 154 to the body 124 and a radial position A1 from the sensor arm 154 to the inner surface of the casing 108. The actuator 306 of the positioning mechanism may retract, e.g., actuate, to displace the sensor arm 154 towards the body 124. The pivot arm 156 provides a reaction force to control and direct the camming motion to move the sensor arm 154 radially. The support arm 160 can be coupled to the sensor arm 154 and the rotational support 142. The support arm 160 and pivot arm 156 react in tandem to maintain the sensor arm 154 parallel to the longitudinal axis. The rotational support 142 may displace longitudinally along the body 124 and/or rotate about the body 124 during actuation and/or operation of the adjustable framework 152. A first sensor array 126, e.g., pulse-echo device 110, can be mounted onto the sensor arm 154 of the first arm 172, e.g., first range arm assembly. Although one first arm 172 is illustrated, it is understood that there may be 2, 3, 4, 5, or any number of first arms 172. Each first arm 172 (first range arm assembly) may be coupled to an actuator 306, e.g., range actuator. For example, a first range arm assembly 172A may be extended by range actuator 306A and a first arm 172B may be extended by range actuator 306B.

The second arm 174 (second range arm assembly) can be constructed similarly to the first arm 172 (first range arm assembly) with a sensor arm 154, a pivot arm 156, a support arm 160, an actuator arm 158, and an actuator 308 (range actuator). The actuator 308, also referred to as range actuator, can extend and retract the sensor arm 154 of the second arm 174. The actuator 308 (range actuator) may extend to cam the sensor arm 154 outward towards the inner surface of the casing 108 to place the sensor arm 154 a radial distance B1 to the inner surface of the casing 108. A second sensor array 128, e.g., the pitch catch array 132, can be mounted onto the sensor arm 154 of the second arm 174 (second range arm assembly). Although one second arm 174 is illustrated, it is understood that there may be 2, 3, 4, 5, or any number of second arms 174 (second range arm assemblies).

In some embodiments, the first sensor array 126 and the second sensor array 128 can be located together on an arm, e.g., the first arm 172, of the rigid framework 106. The first sensor array 126 and second sensor array 128 can be coupled to the sensor arm 154 and arranged to provide a 2D array on the first arm 172 and/or second arm 174. In an alternate embodiment, the first sensor array 126 and the second sensor array 128 can be arranged to provide a 2D array on a third arm. The downhole logging tool assembly 150 may comprise a first arm 172 with a first sensor array 126, a second arm 174 with a second sensor array 128, a third arm with a 2D array (e.g., first sensor array 126 and second sensor array 128), or combinations thereof.

Although the actuators 306 and 308 are illustrated coupled to the actuator support 138 on the downhole side of the logging tool assembly 150 (the side opposite the housing 102), it is understood that the actuators 306 and 308 may be located on the uphole side (the same side as the housing 102). Although the actuators 306 and 308 are illustrated on the same side (the downhole side) of the logging tool assembly 150, it is understood that the actuator 306 may be on the opposite side of the actuator 308. For example, the actuator 306 may be on the uphole side and the actuator 308 may be on the downhole side. Although the actuators 306 and 308 are described as actuating a single arm, e.g., arm 172, it is understood that a single actuator 306 can be coupled to multiple arms, e.g., arm 172A, 172B, and 172C. Although the actuators 306 and 308 are illustrated as in alignment or on the same plane as the first arm 172 and/or second arm 174, it is understood that the actuators 306 may be offset or out of alignment with the first arm 172 and/or second arm 174

The wheel assemblies of the centralizer assembly 104 can include an actuator 180, 182, 184, and 186. Although two wheel assemblies of the centralizer assembly 104 are illustrated on the uphole side of the adjustable framework 152, it is understood that there may be 3, 4, 5, or 6 wheel assemblies spaced radially apart with an equivalent radial spacing, for example, 90 degrees apart for 4 centralizers. Each wheel assembly of the centralizer assembly 104 can include an actuator, e.g., 184 and 186, that acts and reacts separately.

The downhole logging tool assembly 150 can comprise a centralizer assembly 104, e.g., 3 wheel assemblies at 120 degrees, uphole of the adjustable framework 152. The logging tool assembly 150 can comprise a second centralizer assembly 104 downhole of the adjustable framework 152. The logging tool assembly 150 can comprise a third centralizer assembly 104 uphole of the adjustable framework 152.

In some embodiments, in operation, the downhole logging tool assembly 150 the positioning mechanism may extend and retract the adjustable framework. The controller 114 may direct the actuator 306 to extend the first arm 172 from a first radial distance in contact with the body 124 to a second radial distance away from the body 124. The controller 114 may extend the sensor array 126 coupled to the first arm 172 to a predetermined distance relative to the inner surface of the casing 108. The controller 114 can direct the rotation of the adjustable framework 152 relative the body 124 via the rotating motor mount 122. In an alternate embodiment, the actuator support 138 can include a motor and ring gear to generate rotational motion. The controller 114 may direct the sensor array 126 to send and receive acoustic signals via the sensors. The controller may retract the sensor array 126 via the actuator 306 to the first radial distance in contact with the body 124. Likewise, the controller 114 may direct the actuator 308 to extend the second arm 174 to a second radial distance away from the body 124 and retract the second arm 174 back to the first radial distance in contact with the body 124.

In some embodiments, the downhole logging tool assembly 150 can comprise a caliper measurement mechanism. The caliper measurement mechanism comprises multiple armatures, also referred to as arms, extending from the caliper measurement mechanism to contact the target surface, e.g., inner surface of the casing 108. A position sensor attached to the arm provides a measurement of the radial position of the target surface relative to the body 124. The caliper measurement mechanism can be located uphole of the adjustable framework 152, for example, coupled to the housing 102. The caliper measurement mechanism can be located downhole of the adjustable framework 152.

Figure 4A:
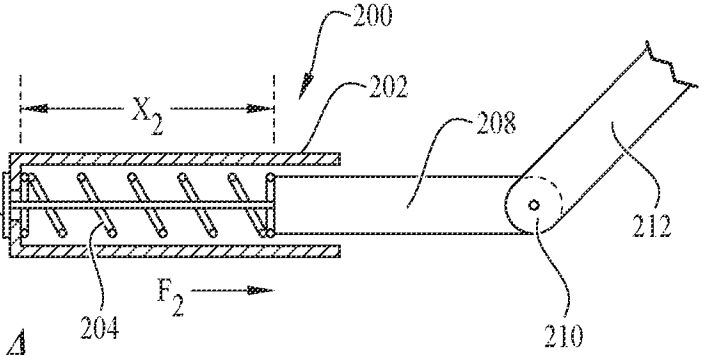
FIGS. 4A, 4B, and 4C are cross-sectional views of actuators according to an embodiment of the disclosure.
Figure 4B:
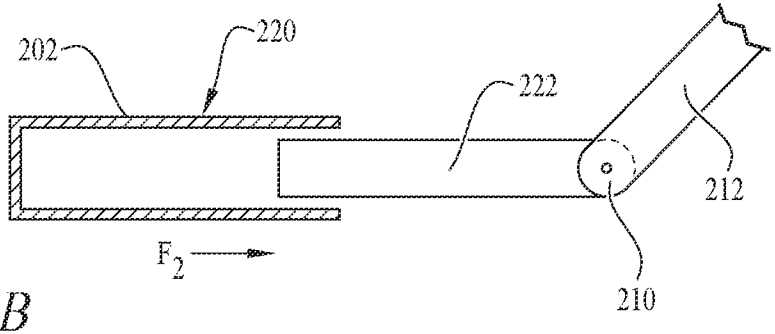
Figure 4C:
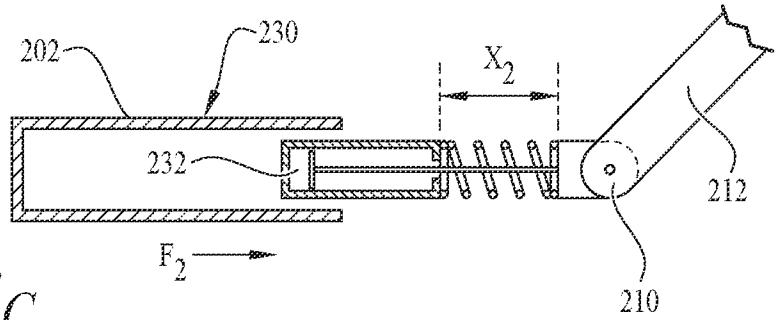
Figure 4B:
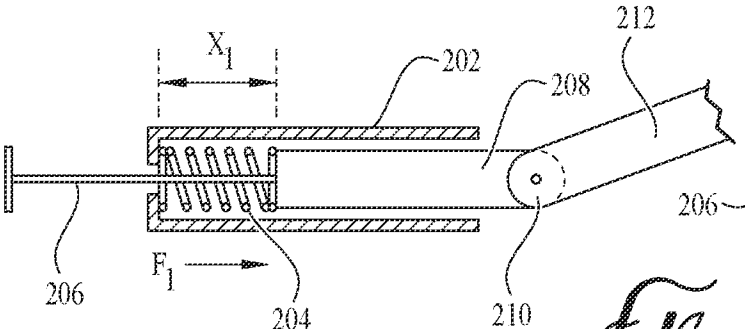
Figure 4B:
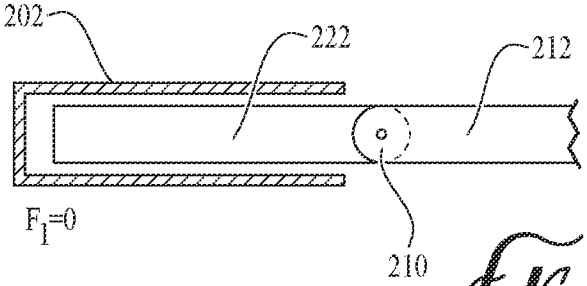
Figure 4C:
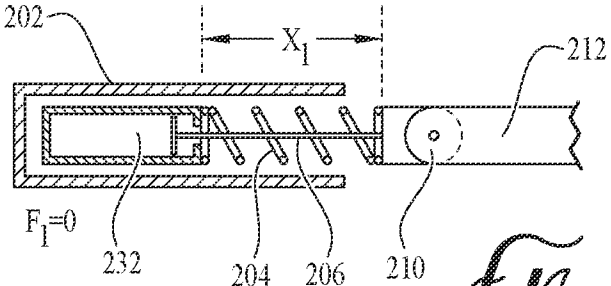

Referring to FIGS. 4A, 4B, and 4C, various embodiments of an actuator are described, for example, as may be utilized as actuator 306 and/or actuator 308. The actuator may comprise a biasing member, an extend-retract mechanism, or combination thereof. The actuator with the biasing member may be configured to extend or to retract, but not both. The actuator with the extend-retract mechanism may be configured to both extend and retract.

Turning now to FIG. 4A, a biased actuator is illustrated. In an embodiment, the biasing type actuator 200 comprises a housing 202, a biasing member 204 (illustrated, for example, as a spring), a biasing member retainer 206, a body 208, a hinge 210, and an arm 212. The biasing type actuator 200 may be configured to extend the actuator from a first position to a second position. In a first position, the biasing member 204 may be under stress to be compressed to a linear length of X1. The biasing stress may bias the biasing member 204 to move the body 208 in a direction towards the arm 212. In a second position, the biasing member 204 can have a relatively small amount or no stress with a linear length of X2. The biasing member retainer may 206 can prevent the body 208 from exiting the housing 202. In some embodiments, the biasing type actuator 200 can include a sensor, e.g., linear transducer, to measure the distance, or the travel, between the body 208 and the housing 202.

In some embodiments, the actuator 180, 182, 184, and 186 for the centralizer assembly 104 include the biasing type actuator 200 of FIG. 4A. Each of the biasing type actuators 200 utilized in actuator 180, 182, 184, and 186 act independently for each wheel assembly of the centralizer assembly 104.

Turning now to FIG. 4B, an arm actuator is illustrated. In an embodiment, the arm actuator 220 comprises a housing 202, a actuator body 222, and an extend-retract mechanism. The arm actuator 220 may be configured to extend and retract with the extend-retract mechanism. The actuator body 222 is mechanically coupled to the housing 202 by the extend-retract mechanism. In various embodiments, the extend-retract mechanism can comprise a hydraulic cylinder, a single pressure gas source with a manifold, a gas generator with a manifold, a motor-driven gear system, a motor-driven threaded extension, or an electromagnetic extend-retract mechanism. In some embodiments, the arm actuator 220 can include a positional sensor, e.g., linear transducer, to measure the distance, or the travel, between the actuator body 222 and the housing 202.

In some embodiments, the extend-retract mechanism can comprise a hydraulic cylinder fluidly coupled to a hydraulic system, for example, having a volume of fluid and a pump. A controller 114 can direct the pump to transfer fluid from a first volume to a second volume, e.g., a piston, to extend the actuator body 222. The pump, via the controller, can transfer the volume of fluid back to the first volume to retract the actuator body 222.

Alternatively, in some embodiments, the extend-retract mechanism can comprise a single gas source with a manifold. A single gas source, e.g., a tank of compressed nitrogen, can supply a manifold comprising at least one valve. A controller 114 can direct the valves in the manifold to actuate, e.g., open or close, to fill a volume with a gas, e.g., a piston, to extend the actuator body 222. A controller 114 can direct the manifold to release the volume of gas from a first volume and fill a second volume with gas to retract the actuator body 222.

Alternatively, in some embodiments, the extend-retract mechanism can comprise a gas generator with a manifold. The gas generator may comprise a volume of gas generated by a chemical reaction of two or more chemicals. The gas generator can supply a manifold to extend and retract the actuator body 222.

Alternatively, in some embodiments, the extend-retract mechanism can comprise an electromagnetic extend-retract mechanism. The housing 202 can comprise a plurality of electromagnets mounted within or attached to the inner surface. The actuator body 222 can comprise a plurality of permanent magnets mounted to the outer surface or installed within. The plurality of electromagnets in the housing 202 can magnetically engage the permanent magnets on the actuator body 222. The actuator body 222 can be extended by a controller 114 turning the electromagnetic fields on and off in a sequence along the housing 202.

Turning now to FIG. 4C, a biasing arm actuator is illustrated. In an embodiment, the biasing arm actuator 230 comprises a housing 202, a biasing member 204, a biasing member retainer 206, and an actuator body 232. The biasing arm actuator may be configured to extend and retract with an extend-retract mechanism. A biasing member may be configured to extend the actuator when a reaction force is encountered. The biasing arm actuator 230 includes an actuator body 232 that is mechanically coupled to the housing 202 by an extend-retract mechanism. The extend-retract mechanism can comprise a hydraulic system with a volume of fluid and a pump, a single pressure gas source with a manifold, a gas generator with a manifold, a motor-driven gear system, a motor-driven threaded extension, or an electromagnetic extend-retract mechanism. The biasing arm actuator 230 can include a biasing member 204 that is unstressed in a first position with a biasing member length of X1. In a second position, the biasing member 204 can be under stress when compressed to a linear length of X2 and bias the biasing member 204 to move the hinge 210 in a direction towards the arm 212. The biasing member retainer may 206 can couple the actuator body 232 to the hinge 210. In some embodiments, the biasing arm actuator 230 can include a positional sensor, e.g., linear transducer, to measure the distance, or the travel, between the actuator body 232 and the housing 202.

In some embodiments, the actuators for the centralizer assembly 104 may be biasing arm actuator 230 of FIG. 4C. The biasing arm actuator 230, utilized in actuator 180, 182, 184, and 186, may be controlled by the controller 114 located within the housing 102. The actuator body 232 can be directed to extend or retract the wheel assembly of the centralizer assembly 104. The controller 114 can independently operate the wheel assembly of the centralizer assemblies 104 when using biasing arm actuator 230 within actuator 180, 182, 184, and 186.

Although three types of actuators are described, it is understood that there are other configurations of actuators that can extend and retract. Although six types of extend-retract mechanisms are disclosed, it is understood that other configurations of the mechanisms than those described may be used.

In some embodiments, the radial position/displacement of the first arm 172 and/or the second arm 174 may be controlled via a control mechanism. In some embodiments, as will be disclosed herein, the control mechanism may be characterized as active feedback, for example, the actuators 306 and/or 308 may extend the adjustable framework 152 with arm actuators 220 or biasing arm actuators 230 via an extend-retract mechanism. A controller 114 may communicate with a control mechanism to extend the adjustable framework 152 to a predetermined distance from the inner surface of the casing 108. The control mechanism may communicate the radial position of the inner surface of the casing 108 to provide the controller 114 a radial position threshold to extend the adjustable framework within. For example, in some embodiments, the actuator 306 for the first arm 172 and actuator 308 for the second arm 174 may be arm actuator 220. The actuator 306 and actuator 308 may act independently from each other. The controller 114 within the housing 102 can direct the extend-retract mechanism of arm actuator 220 (actuator 306) for the first arm 172 to radially position the sensor, e.g., 124, a distance of A1 from the inner surface of the casing 108. Similarly, the controller 114 can direct the extend-retract mechanism of arm actuator 220 (actuator 308) for the second arm 174 to radially position the sensor, e.g., 128, a distance of B1 from the inner surface of the casing 108. The extend-retract mechanism may be any of the previously disclosed methods.

In some embodiments, the actuators for the centralizer assembly 104 can provide feedback to the controller 114 via a positional sensor, e.g., linear transducer. The positional sensors, e.g., linear transducers, can measure the distance of travel from a first position to a second position within the actuator. The controller 114 may determine a measurement of the inner diameter of the casing 108 with the distance measurement or displacement measurement from the sensor within the actuator 180, 182, 184, and/or 186.

In some embodiments, the positional sensor can be a linear transducer, a rotary encoder, a shaft encoder, an optical encoder, a magnetic encoder, or combinations thereof. The positional sensor can determine a positional value based on a physical position of the sensor. The rotary encoder can determine a position value based on physical contact to a surface, e.g., an outer surface of a shaft. An optical encoder can determine a positional value based on an optical pattern on a surface. The magnetic encoder and linear transducer can use a series of magnetic poles to determine a position between two surfaces. In some embodiments, the positional sensor can determine a position along a rod or shaft. In some embodiments, the positional sensor can be located at a hinge, e.g., hinge 210 in FIGS. 4A-C, and determine a positional value based on rotary movement.

In some embodiments, the actuators for the centralizer assembly 104 can provide active feedback to the controller 114 for the radial position A1. The controller 114 may determine a measurement of the inner diameter of the casing 108 by a linear measurement from a sensor within the actuator of the centralizer assembly 104. The controller 114 may direct the first arm 172 to extend to the radial position A1 based on the measurement of the inner diameter of the casing 108. Similarly, the controller 114 may direct the second arm 174 to extend to the radial position B1 based on the measurement of the inner diameter of the casing 108. The controller 114 may change the radial position A1 and B1 based on changes to the inner diameter measured by the sensors within the actuators for the centralizer assembly 104.

In some embodiments, the sensor array 126 and/or 128 mounted on the sensor arm 154 of the adjustable framework 152 can provide active feedback to the controller 114 for the radial position A1 and/or B1. The sensor arrays 126 and/or 128 can provide measurements of a distance from the sensor array 126 and/or 128 to the inner surface of the casing 108.

Alternatively, the control mechanism may be characterized as passive feedback, for example, radial position of the first arm 172 and/or second arm 174 to the inner surface of the casing 108 is maintained by a passive placement assembly in direct contact with the inner surface of the casing 108 as will be disclosed herein.

Figure 5:
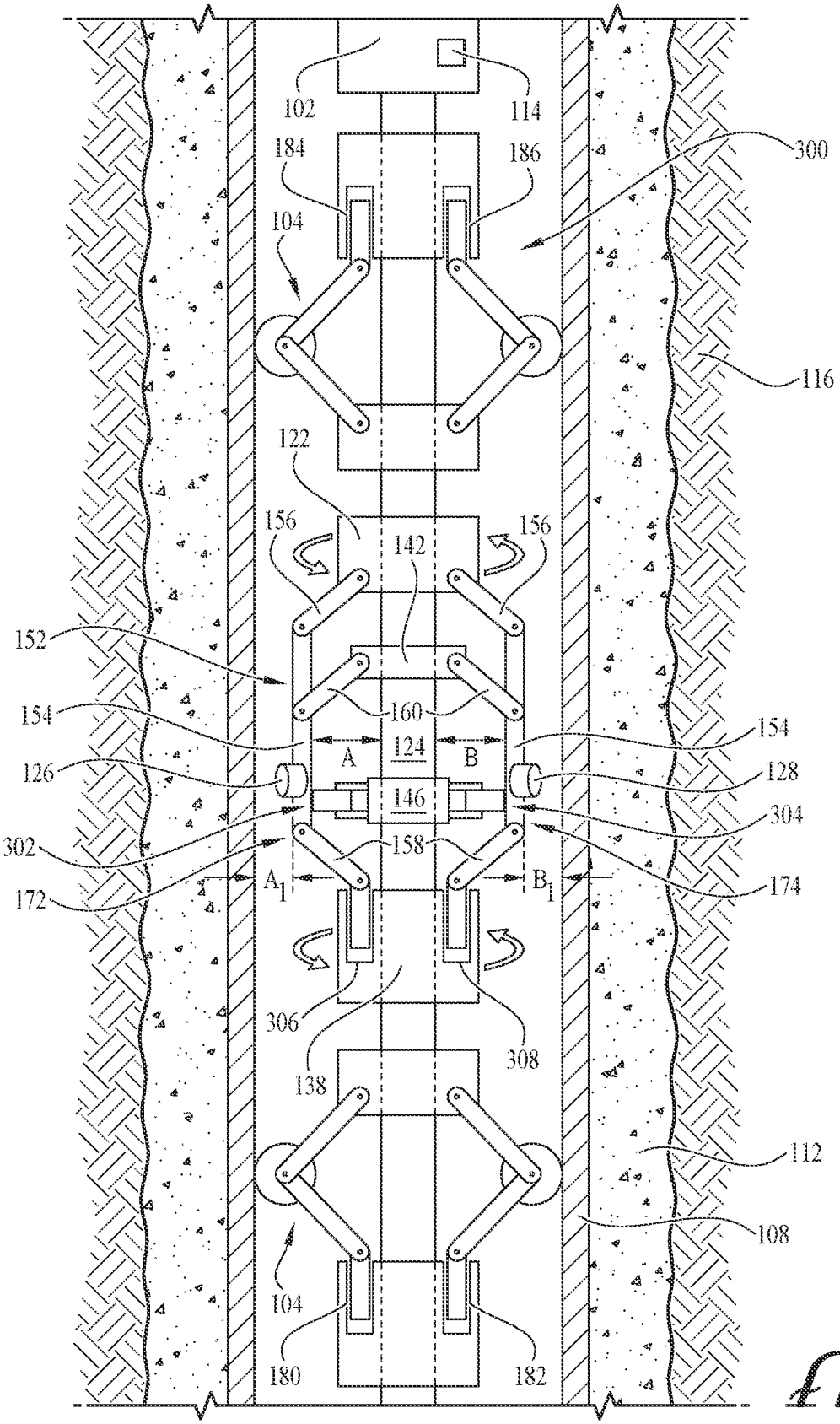
FIG. 5 is a side view of a downhole logging tool assembly with an adjustable framework according to another embodiment of the disclosure.

Turning now to FIG. 5, an embodiment of the wireline logging tool assembly 22 is illustrated. For example, FIG. 5 illustrates a side view of a logging tool assembly 300. In some embodiments, the logging tool assembly 300 comprises a housing 102, at least one centralizer assembly 104, an adjustable framework 152, and a plurality of sensors. The adjustable framework 152 can comprise a first arm 172 with a first sensor array 126 and a second arm 174 with a second sensor array 128. The logging tool assembly 300 may include similar components to FIG. 3 as previously described.

The adjustable framework 152 can include a radial actuator 302 for the first arm 172 and a radial actuator 304 for the second arm 174. The radial actuators 302 and 304 may be communicatively coupled to the controller 114 and may direct the radial actuators 302 and 304 during operation of the logging tool assembly 300. The radial actuator 302 and 304 may be biasing type actuator 200 of FIG. 4A, arm actuator 220 of FIG. 4B, or biasing arm actuator 230 of FIG. 4C. The controller 114 can direct the radial actuator 302 and radial actuator 304 independently from each other. The controller 114 can direct the extend-retract mechanism of radial actuator 302 for the first arm 172 to radially position the sensor, e.g., 124, a distance of A1 from the inner surface of the casing 108. The controller 114 can direct the extend-retract mechanism of radial actuator 304 for the second arm 174 to radially position the sensor, e.g., 128, a distance of B1 from the inner surface of the casing 108.

In some embodiments, the radial actuator 302 can be coupled to the sensor arm 154 and a rotational base 146. The rotational base 146 can rotate and move axially about the body 124. In an alternative embodiment, the radial actuator 302 can be coupled to the rotational base 146 and can contact the inside surface of the sensor arm 154 with a sliding fit. The sensor arm 154 may slide along the end surface of the radial actuator 302 as the actuator 302 154 radially positions the sensor arm 154 relative to the body 124.

In some embodiments, the downhole logging tool assembly 300 may comprise a first arm 172 with a first sensor array 126, a second arm 174 with a second sensor array 128, a third arm with a 2D array (e.g., first sensor array 126 and second sensor array 128), or combinations thereof.

Figure 6:
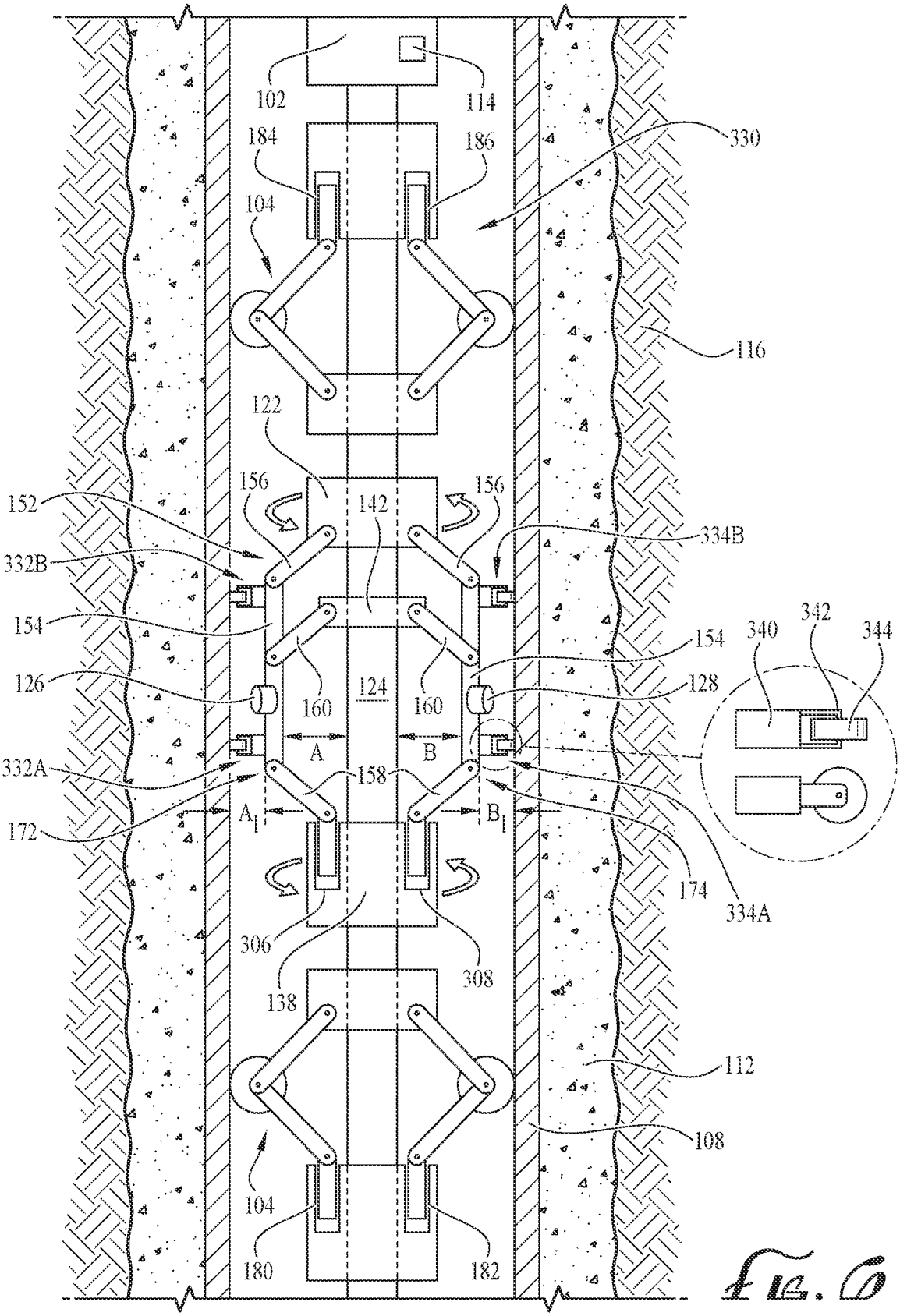
FIG. 6 is a side view of a downhole logging tool assembly with an adjustable framework according to still another embodiment of the disclosure.

Turning now to FIG. 6, an embodiment of the wireline logging tool assembly 22 is illustrated. For example, FIG. 6 illustrates a side view of a downhole logging tool assembly 330. In some embodiments, the downhole logging tool assembly 330 comprises a housing 102, at least one centralizer assembly 104, an adjustable framework 152, and a passive placement assembly 332. The adjustable framework 152 can comprise a first arm 172 with a first sensor array 126 and a second arm 174 with a second sensor array 128. The logging tool assembly 330 may include similar components to FIG. 3 and FIG. 5 as previously described.

The adjustable framework 152 can include a passive placement assembly 332 and 334 comprising an extension 340, an axle assembly 342, and roller wheel 344. The passive placement assembly 332 and 334 can be referred to as a roller extension assembly or a roller assembly. The passive placement assembly 332 can be mechanically coupled the sensor arm 154 to place the first sensor array 126 at a distance A1 from the target surface. The passive placement assembly 334 can be mechanically coupled to the sensor arm 154 to place the second sensor array 128 at a distance B1 from the target surface. The roller wheel 344 is rotationally coupled to the axle assembly 342. The axle assembly 342 can be rotationally coupled to the extension 340 to allow the roller wheel 344 to pivot or turn along a combined longitudinal and rotational path on the target surface. The sensor arm 154 is illustrated with roller extension assembly 332A and 332B on the first arm 172 and roller extension assembly 334A and 334B on the second arm 174. The roller extension assembly 334 and 332 may be identical or may have a different length of extension 340. Although two roller extension assemblies are illustrated coupled to the first arm 172 and coupled to the second arm 174, it is understood that the first arm 172 and the second arm 174 may have 1, 2, 3, 4, or any number of roller extension assemblies 332 and 334.

In some embodiments, the passive placement assembly 332 can comprise a slidable shape in place of the roller wheel 344. The slidable shape can include a skid, a sliding block, a plate, a pin, a ball, a rolling device, a separation element, or combinations thereof.

In some embodiments, the roller extension assembly 332 and/or 334 can be rigidly fixed with respect to sensor arm 154 of the first arm 172 and/or second arm 174. Alternatively, the roller extension assembly 332 and/or 334 can be movable/adjustable. For example, the roller extension assembly 332 and/or 334 may include an actuator communicatively coupled to the controller 114 and configured to alter/set the radial distance that the extension assembly extends from the sensor arm 154 thus changing the radial distance between the sensor, e.g., the first sensor array 126, and the target surface.

In some embodiments, the roller extension assembly 332 and/or 334 can provide the feedback loop for the controller. The controller 114 can extend the adjustable framework 152 until the roller extension assemblies 332 and/or 334 contact the inner surface of the casing 108.

In some embodiments, the roller extension assembly 332 and/or 334 can comprise an actuator. The extension 340 can include a biasing type actuator 200, an arm actuator 220, or a biasing arm actuator 230. For example, the roller extension assembly 332 and/or 334 may be a biasing type actuator 200 to allow the roller wheel 344 of the roller extension assembly 332 and/or 334 to follow the occurrence of ovality within the inner surface of the casing 108 as the adjustable framework 152 rotates.

In some embodiments, the roller extension assembly 332 and/or 334 can comprise a motorized wheel assembly. The axle assembly 342 and/or roller wheel 344 can include a motor communicatively connected to the controller 114. The motorized wheel assembly, the rotating motor mount 122, or combination thereof can generate a rotary motion of the adjustable framework 152. In some embodiments, the axle assembly 342 can include a directional swivel directed by the unit controller 114. The angle of the motorized wheel assembly can generate rotation of the adjustable framework 152. The combination of the longitudinal direction of travel of the logging tool assembly 300, via the logging cable 6, and the angle of the motorized wheel assembly can create a helical rotation path of the motorized wheel assembly along the target surface, e.g., inner surface of the casing 108. In some embodiments, the roller wheels 344 can be roller balls.

In some embodiments, the controller 114 can radially adjust the adjustable framework 152 with the actuator within roller extension assembly 332 and/or 334. The controller 114 can direct the extend-retract mechanism of actuator for the first arm 172 and/or the second arm 174 to radially position the sensor, e.g., 110, a distance from the inner surface of the casing 108.

In some embodiments, the downhole logging tool assembly 330 may comprise a first arm 172 with a first sensor array 126, a second arm 174 with a second sensor array 128, a third arm with a 2D array (e.g., first sensor array 126 and second sensor array 128), or combinations thereof.

In an embodiment, a wireline logging operation can comprise a wireline logging tool assembly, e.g., 150 of FIG. 3, communicatively coupled to a surface logging equipment by wireline or logging cable 6 as shown in FIG. 1. The downhole logging tool assembly 150 may be conveyed into the wellbore 8 on a workstring, e.g., logging cable 7, to a target depth, for example formation 10. The adjustable framework 152 may be extended or retracted during conveyance to the target depth.

In some embodiments, the adjustable framework 152 may be extended by the actuator 306 and/or 308 during conveyance into the wellbore 8. For example, with the logging tool assembly 330 the actuators 306 and/or 308 may extend the adjustable framework 152 with biasing type actuators 200. A roller extension assembly 332 may provide a control mechanism to extend the adjustable framework 152 to a predetermined distance from the inner surface of the casing 108. A rotating motor mount 122 may rotate the adjustable framework 152 relative to the body 124. A first sensor array 126 coupled to the first arm 172 and a second sensor array 128 coupled to the second arm 174 may transmit and receive acoustic signals. The casing 108 may have an irregular inner surface due to manufacturing, e.g., inner diameter variations, due to material loss, e.g., erosion, or due to bending, e.g., ovality. The actuators 306 and/or 308 can keep the sensor array 126 and/or 128 extended and the roller extension assembly 332 can maintain the sensor array 126 and/or 128 at a predetermined distance from an irregular inner surface of the casing 108.

In some embodiments, the adjustable framework 152 may be extended by the actuator 306 and/or 308 after conveyance into the wellbore 8. For example with the logging tool assembly 150, 300, and 330, the adjustable framework 152 may remain in a retracted position, e.g., proximate to the body 124, during conveyance to the target depth or at least a portion of the target depth. The actuators 306 and/or 308 may extend the adjustable framework 152 with arm actuators 220 or biasing arm actuators 230 via an extend-retract mechanism. A unit controller may communicate with a control mechanism to extend the adjustable framework 152 to a predetermined distance from the inner surface of the casing 108. The control mechanism may comprise i) the sensor array 126, ii) a linear transducer within the actuator 306, iii) a linear transducer within a centralizer assembly 104, iv) a roller assembly, or v) combinations thereof. A rotating motor mount 122 may rotate the adjustable framework 152 relative to the body 124. A first sensor array 126 coupled to the first arm 172 and a second sensor array 128 coupled to the second arm 174 may transmit and receive acoustic signals. The controller 114 can utilize communication from the control mechanism to direct the actuators 306 and/or 308 to extend and/or retract the sensor array 126 and/or 128 to maintain the sensor array 126 and/or 128 at a predetermined distance from an irregular inner surface of the casing 108.

The wireline logging operation comprises lowering the wireline logging tool assembly, e.g., 150, to a target depth, e.g., the formation 10, and subsequently pulling the wireline logging tool assembly, e.g., 150, upward (toward the surface) at a substantially constant speed. During the upward motion through a target zone, e.g., a series of depths, the senor arrays 126 and/or 128 may perform measurements within the wellbore 8. For example, the sensor arrays 126 and/or 128 can make one or more measurements of the formation 10, the cement 24, the casing string 18, or combinations thereof. The measurement data may be stored in memory or transmitted to surface via the logging cable 6. The measurement data can be communicated to a surface logging facility 4 for storage, processing, and analysis.

The systems and methods disclosed herein may be advantageously employed in the context of wellbore servicing operations, particularly, in relation to the usage of a sensor array on a downhole tool assembly as disclosed herein.

In an embodiment, the downhole tool assembly may have a sensor position adjustment assembly configured to move a sensor array, e.g. first sensor array 126, to a predetermined position relative to the inner surface of the casing 108. For example, a controller may direct an actuator to radially move a first sensor array 126 to a predetermined distance from the inner surface of the casing 108. The sensor positioning process disclosed herein, in which a unit controller may determine a radial distance from the sensor array, e.g., 126, to the inner surface of the casing 108 via a positional sensor, radially extend the sensor array, e.g., 126, to the predetermined radial distance, and adjust the predetermined radial distance in response to an active feedback signal. The sensor positioning process can place the sensor array, e.g., 126, at a predetermined distance to the inner surface of the casing 108 and thus improve the operation of the downhole sensor array.

Additionally or alternatively, the sensor positioning process disclosed herein may position a sensor array, e.g. first sensor array 126, to a predetermined position relative to the inner surface of the casing 108 with a passive feedback system. A passive placement assembly in direct contact with the inner surface of the casing 108 may maintain the radial position of the sensor array, e.g., 126, at a predetermined radial position to the inner surface of the casing 108. The sensor positioning process can place the first sensor array 126 at a predetermined radial distance to the inner surface of the casing 108 and thus improve the operation of the downhole sensor array.

Additionally or alternatively, the sensor positioning process disclosed herein may utilize an active feedback device to adjust the position of the sensor array. For example, unit controller may radially move the sensor array in response to a change in the radial distance of the inner surface of the casing 108 as determined by a positional sensor within the centralizer. The sensor positioning process can place the sensor array, e.g., 126, at a predetermined distance to the inner surface of the casing 108 and thus allow the operation of the downhole sensor array within multiple sizes of casing.

Additional Disclosure

The following are non-limiting, specific embodiments in accordance with the present disclosure:

A first embodiment, which is a downhole sensor position adjustment assembly, comprising a body 124, a centralizer assembly 104 coupled to the body 124, an adjustable framework 152 coupled to the body 124, a sensor array 126 coupled to the adjustable framework 152, wherein the adjustable framework 152 is configured to radially displace the sensor array 126, a positioning mechanism coupled to the adjustable framework 152 and configured to actuate the adjustable framework, and a control mechanism configured to position the adjustable framework 152 a predetermined radial distance from the body 124.

A second embodiment, which is the adjustment assembly of the first embodiment, wherein the adjustable framework 152 comprises a first arm 172, wherein the first arm 172 comprises a sensor arm 154 and an actuator arm 158, and wherein the positioning mechanism is directly coupled to the sensor arm 154 or coupled to the sensor arm 154 via the actuator arm 158.

A third embodiment, which is the adjustment assembly of the second embodiment, wherein the positioning mechanism comprises a biasing actuator, wherein the control mechanism is a passive placement assembly configured to position the sensor array 126 a predetermined radial distance from the body 124, and wherein the passive placement assembly is a roller assembly or sliding assembly.

A fourth embodiment, which is the adjustment assembly of any of the first through the third embodiments, further comprising a controller 114 communicatively connected to the positioning mechanism comprising a control actuator, wherein the control actuator comprises an extend-retract mechanism, a biasing member, or combination thereof, wherein the controller 114 is configured to actuate the extend-retract mechanism, wherein the control mechanism comprises i) the sensor array 126, ii) a positional sensor within the actuator 306, iii) a positional sensor within the centralizer assembly 104, iv) a roller assembly, or v) combinations thereof, and wherein the control mechanism is configured to provide a feedback signal to the controller 114 of the position of the adjustable framework 152 relative to the body 124.

A fifth embodiment, which is the adjustment assembly of the fourth embodiment, wherein in the extend-retract mechanism is one of i) a hydraulic system with a volume of fluid and a pump, ii) a single pressure source with a manifold, iii) a gas generator with a manifold, iv) a motor-driven a gear system, v) a motor turning a threaded extension, or vi) an electromagnetic extend-retract mechanism.

A sixth embodiment, which is the adjustment assembly of any of the first through the fifth embodiments, wherein the adjustable framework 152 comprises a second arm 174, wherein the second arm 174 comprises a sensor arm 154 and an actuator arm 158, and wherein the positioning mechanism is directly coupled to the sensor arm 154 or coupled to the sensor arm 154 via the actuator arm 158.

A seventh embodiment, which is the adjustment assembly of any of the first through the sixth embodiments, wherein the centralizers comprise an second actuator, a positional sensor, or combinations thereof, wherein the second actuator comprises a biasing member, an extend-retract mechanism, or combinations thereof, and wherein the positional sensor is configured to provide a signal to the controller 114.

An eighth embodiment, which is the adjustment assembly of any of the first through the seventh embodiments, wherein the sensor array 126 comprises an acoustic sensor including i) a first pulse-echo device, ii) a second pulse-echo device, iii) a pitch/catch array 132 comprising at least two transmitters 134 and a plurality of receivers 136, or iv) combinations thereof.

A ninth embodiment, which is the adjustment assembly of any of the first through the eighth embodiments, further comprising a rotating motor mount 122 coupled to the adjustable frame, wherein the rotating motor mount 122 is configured to rotate the adjustable framework 152.

A tenth embodiment, which is the adjustment assembly of any of the first through the ninth embodiments, wherein a radial distance from the sensor array 126 to a target surface is determined by the radial distance from the adjustable framework 152 to the body 124, and wherein the target surface is an inner surface of a wellbore, a tubular member, or a formation.

An eleventh embodiment, which is a method of logging at least a portion of a subterranean formation penetrated by a wellbore, comprising conveying a first sensor array 126 coupled to a first arm 172 of an adjustable framework 152 into a wellbore on a workstring, radially extending the first sensor array 126 from a first radial position relative to a body 124 via an actuator 306 coupled to the first arm 172, wherein the actuator 306 comprises a biasing member, an extend-retract mechanism, or combination thereof, and radially moving the first sensor array 126 to a second radial distance relative to the body 124 via the actuator 306 in response to a control mechanism comprising i) the sensor array 126, ii) a first positional sensor on the actuator 306, iii) a second positional sensor on a centralizer assembly 104, iv) a roller, or v) combinations thereof.

A twelfth embodiment, which is the method of the eleventh embodiment, further comprising determining a radial distance from the first sensor array 126 to the body 124 via i) a sensor array 126, ii) positional sensor within a centralizer assembly 104, iii) a roller assembly, or iv) combinations thereof.

A thirteenth embodiment, which is the method of any of the eleventh and the twelfth embodiments, further comprising conveying a second sensor array 128 coupled to a second arm 174 of the adjustable framework 152, radially extending the second sensor array 128 from a first radial position relative to the body 124 via an actuator 308 coupled to the second arm 174 to a second radial distance from the second sensor array 128 to the body 124, and radially retracting the second sensor array 128 via the actuator 308 in response to a signal from a control mechanism.

A fourteenth embodiment, which is the method of any of the eleventh through the thirteenth embodiments, further comprising rotating the first sensor array 126 by a rotating motor mount 122 mechanically coupled to the first arm 172 of the adjustable framework 152.

A fifteenth embodiment, which is the method of any of the eleventh through the fourteenth embodiments, further comprising sending and receiving an acoustic signal from the sensor array.

A sixteenth embodiment, which is a system of a wellbore logging assembly, comprising a surface logging facility 4, a body 124 coupled to the surface logging facility 4 by a workstring, a centralizer assembly 104 coupled to the body 124, an adjustable framework 152 coupled to the body 124, a first sensor array 126 coupled to a first arm 172 radially positionable by a first actuator 306, wherein an extend-retract mechanism of the first actuator 306 radially positions the sensor array 126 a first radial distance from the first sensor array 126 to a first radial distance to the body 124, a positioning sensor providing feedback of the first radial distance of the first sensor array 126 to the body 124, a controller 114 comprising a processor and a non-transitory memory communicatively coupled to the surface logging facility 4, configured to measure a second radial distance from the body 124 by a control mechanism, move the first sensor array 126 coupled to the first arm 172 via the actuator 306 to the second radial distance, and adjust the second radial distance of the first arm 172 in response to detecting a change in the second radial distance.

A seventeenth embodiment, which is the system of the sixteenth embodiment, further comprising a second sensor array 128 coupled to a second arm 174 radially positionable by a second actuator 308 wherein an extend-retract mechanism of the second actuator 308 radially positions the second sensor array 128 a first radial distance from the second sensor array 128 to the body 124, and a positioning sensor providing feedback of the first radial distance of the second sensor array 128 to the body 124.

An eighteenth embodiment, which is the system of the seventeenth embodiment, wherein the positioning sensor is within the actuator, within the centralizer assembly, or both.

A nineteenth embodiment, which is the system of the seventeenth embodiment, wherein the first arm 172 is independent of the second arm 174.

A twentieth embodiment, which is the system of any of the sixteenth through the nineteenth embodiments, wherein the control mechanism is i) the sensor array, ii) a positioning sensor, iii) a roller extension assembly, or iv) combination thereof.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A downhole sensor position adjustment assembly, comprising:

a body;

a first centralizer assembly coupled to the body;

a second centralizer assembly coupled to the body;

an adjustable framework coupled to the body and positioned between the first and second centralizer assemblies;

a sensor array coupled to the adjustable framework, wherein the adjustable framework is configured to radially displace the sensor array;

a range actuator coupled to the adjustable framework and configured to actuate the adjustable framework; and a controller configured to control the range actuator to position the sensor array via the adjustable framework to maintain a spacing between the sensor array and a surface of a casing, wherein the range actuator comprises an extend-retract mechanism, wherein the extend-retract mechanism is a hydraulic system comprising a pump, a single pressure source comprising a manifold, a gas generator comprising a manifold, a motor-driven gear system, a motor configured to turn a threaded extension, or an electromagnetic mechanism, and wherein the controller is configured to actuate the extend-retract mechanism in response to a control signal.

2. The downhole sensor position adjustment assembly of claim 1, wherein the adjustable framework comprises a first range arm assembly, wherein a first sensor of the sensor array is coupled to the first range arm assembly; and wherein the range actuator is coupled to the first range arm assembly.

3. The downhole sensor position adjustment assembly of claim 2, wherein the adjustable framework further comprises a second range arm assembly, wherein a second sensor of the sensor array is coupled to the second range arm assembly; and wherein the range actuator is coupled to the second range arm assembly.

4. The downhole sensor position adjustment assembly of claim 1, wherein the first or second centralizer assembly comprises a second actuator; and wherein the second actuator comprises a biasing member or an extend-retract mechanism.

5. The of downhole sensor position adjustment assembly of claim 4, wherein the first actuator and the second actuator is are communicatively coupled to the controller.

6. The downhole sensor position adjustment assembly of claim 1, wherein the sensor array comprises an acoustic sensor including a pulse-echo device or a pitch/catch array comprising transmitters and receivers.

7. The downhole sensor position adjustment assembly of claim 1, further comprising a motor mount coupled to the adjustable framework, wherein the motor mount is configured to rotate the adjustable framework.

8. The downhole sensor position adjustment assembly of claim 1, wherein a radial distance from the sensor array to the surface is determined by a radial distance from the adjustable framework to the body, and wherein the surface is an inner surface of a wellbore, a tubular member, or a formation.

9. The downhole sensor position adjustment assembly of claim 1, wherein the range actuator comprises a biasing member.

10. The downhole sensor position adjustment assembly of claim 1, wherein the first centralizer assembly and the second centralizer assembly comprise wheel assemblies, wherein each of the wheel assemblies comprises a roller wheel coupled to a roller arm, and wherein the roller wheel is configured to contact the surface.

11. The downhole sensor position adjustment assembly of claim 10, wherein each of the wheel assemblies comprises a positional sensor coupled to the roller arm, and wherein the positional sensor is communicatively coupled to the controller.

12. The downhole sensor position adjustment assembly of claim 1, wherein the controller is further configured to control the range actuator based on a radial position of the adjustable framework relative to the body and a radial position of the surface.

13. The downhole sensor position adjustment assembly of claim 1, wherein the controller is further configured to control the range actuator based on a control signal, and wherein the sensor array, a positional sensor within the arm actuator, a second positional sensor within the centralizer assembly, a roller assembly, or combinations thereof are configured to provide a control signal to the controller.

14. The downhole sensor position adjustment assembly of claim 1, wherein the controller is further configured to control the range actuator to maintain a constant spacing between the sensor array and the surface of the casing based on a measurement of an inner diameter of the casing.

15. The downhole sensor position adjustment assembly of claim 1, wherein the controller is further configured to control the range actuator to maintain a constant spacing between the sensor array and the surface of the casing by changing a radial position of the sensor array based on a detected change of a measurement of an inner diameter of the casing.

16. The downhole sensor position adjustment assembly of claim 1, wherein the spacing is a radial distance between the sensor array and the surface of the casing.

17. The downhole sensor position adjustment assembly of claim 1, wherein the controller is further configured to control the range actuator to position the sensor array via the adjustable framework to adjust and maintain the spacing between the sensor array and the surface of the casing.

18. A system for wellbore logging, comprising:

a surface logging facility;

a body coupled to the surface logging facility by a workstring;

a first centralizer assembly coupled to the body;

a second centralizer assembly coupled to the body;

an adjustable framework coupled to the body and positioned between the first and second centralizer assemblies;

a sensor array coupled to the adjustable framework, wherein the adjustable framework is configured to radially displace the sensor array;

a range actuator coupled to the adjustable framework and configured to actuate the adjustable framework; and a controller configured to control the range actuator to position the sensor array via the adjustable framework to maintain a spacing between the sensor array and a surface of a casing, wherein:

the sensor array comprises a first sensor array and a second sensor array;

the actuator comprises a first actuator and a second actuator;

the first sensor array is coupled to a first arm, which is radially positionable by the first actuator;

an extend-retract mechanism of the first actuator is configured to position the first sensor array a first radial distance from the body;

the second sensor array is coupled to a second arm, which is radially positionable by the second actuator; and an extend-retract mechanism of the second actuator is configured to position the second sensor array a second radial distance from the body.

19. The system of claim 18, wherein the controller is further configured to control the range actuator based on a signal from one or more positioning sensors, and wherein the one or more positioning sensors are located within the actuator, the first centralizer assembly, the second centralizer assembly, the sensor array, or combinations thereof.

20. The system of claim 18, wherein the controller is further configured to adjust the first radial distance independently from the second radial distance.

21. The system of claim 19, wherein the one or more positioning sensors comprise a roller extension assembly.

* * * * *